US005130605A

United States Patent [19]

Ogawa et al.

[11] Patent Number: 5,130,605

[45] Date of Patent: Jul. 14, 1992

[54] LIGHTING DEVICE FOR FLUORESCENT LAMP

[75] Inventors: Soichiro Ogawa, Nishitama; Takao Shimizu, Ome; Hiromitsu Matsuno, Hachioji, all of Japan

[73] Assignee: Hitachi, Ltd., Tokyo, Japan

[21] Appl. No.: 664,223

[22] Filed: Mar. 4, 1991

[30] Foreign Application Priority Data

Mar. 7, 1990 [JP] Japan ..... 2-53644

[51] Int. Cl.[5] ..... H05B 41/36

[52] U.S. Cl. ..... 315/105; 315/101; 315/107; 315/209 R; 315/DIG. 7

[58] Field of Search ..... 315/105, 106, 107, 94, 315/101, 229, 209 R, 225, 226, 205, DIG. 4, DIG. 7

[56] References Cited

U.S. PATENT DOCUMENTS 4,682,080 7/1987 Ogawa et al. ..... 315/106 X

FOREIGN PATENT DOCUMENTS 63-202841 8/1988 Japan .

*Primary Examiner*—Eugene R. Laroche
*Assistant Examiner*—Ali Neyzari
*Attorney, Agent, or Firm*—Fay, Sharpe, Beall, Fagan, Minnich & McKee

[57] ABSTRACT

A lighting device for a hot cathode fluorescent lamp used for a back light of a liquid crystal display or the like attempts to prolong the life of a lamp in a lighting device for a low consumption wattage fluorescent lamp. More specifically, the hot cathode fluorescent lamp is started while being pre-heated, and even after starting, a pre-heat current keeps flowing. The pre-heat current value after starting is set to be smaller than that at the time of starting for the purpose of optimizing the hot spot temperature. With employment of the configuration as described above, the lifetime of the hot cathode fluorescent lamp when used as a back light can extend to 10,000 hours or more.

4 Claims, 2 Drawing Sheets

IN PREHEATING

IN LIGHTING

LIGHTING DEVICE FOR FLUORESCENT LAMP

BACKGROUND OF THE INVENTION

The present invention relates to a lighting device for a hot cathode fluorescent lamp used, for example, for a back light of a liquid crystal display and the like.

In a conventional lighting device for a hot cathode fluorescent lamp used for a back light of a liquid crystal display, starting up the lamp is effected without pre-heating a filament of the lamp in order to light the lamp as disclosed in Japanese Patent Laid-open No. 63(1988)-202841 publication.

As a typical device which uses such a lighting device as described above, there can be mentioned one of which display has a small image plane as in a liquid crystal television.

The reasons why starting up the lamp is effected without pre-heating in such uses as described above are that first, the need of reducing the cost is greatly desired and a pre-heat circuit does not thereby render the reduction in cost possible, and secondly, the need of reducing consumption wattage is greatly desired.

The aforemention second reason will be further described. As a premise, a liquid crystal television is driven using a battery having a small capacity so that the consumption wattage is limited to approximately 3 Watts at the maximum.

For this reason, when a pre-heat circuit is added to the aforementioned conventional lighting device, the pre-heat circuit consumes power similarly to the case during lighting even if the back light is being lighted, thus resulting in a loss of power.

A lamp current is practically of the order of 20 to 20 mA in order to suppress the consumption wattage of the liquid crystal television to approximately 2 to 3 Watts. If a configuration is employed in which a pre-heat circuit is provided to pre-heat a filament even during lighting of a lamp, a value of pre-heat current assumes a value close to a current value of the lamp, which has actually no sense to cause Pre-heating. In other words, the design of causing Pre-heating sufficiently occur becomes difficult if consumption wattage is limited.

Further, in order that disconnection of a lamp filament is made difficult to occur to attain a long life of the lamp, it is necessary to increase a quantity of oxide to be coated on the filament. As a preferable means, there is a means wherein a tungsten coil used as a filament coil is formed into a triple coil to increase a surface area of coating to thereby increase the quantity of oxide to be coated.

However, there is a problem in that if a triple coil is used, a pre-heat current increases as compared with a double coil. Therefore, the triple coil has not been put to practical use as a filament of a back light used for applications such as a liquid crystal television for which consumption wattage is restricted.

As described above, since the conventional lighting device for a hot cathode lamp employs a system for causing lighting without pre-heating a filament of a lamp, there is an advantage that the configuration of a portion of the light circuit out of the lighting device can be obtained simply.

However, there is a problem in that since a filament receives a strong ion impact at the time of starting up the lamp, the filament is apt to break, and accordingly, the life of the lamp is shortened.

Namely, when the lamp is lighted without pre-heating the filament, a discharge passes through a glow-discharge area when the lamp is lighted. Electrons supplied from a cathode for maintaining the discharge of the lamp at that time are compensated for by electrons emitted in a manner that electrodes are hammerred by ions accelerated by a high voltage.

Therefore, a tungsten filament is impacted by ions so that the filament gradually reduces its diameter, finally snapping the filament.

SUMMARY OF THE INVENTION

It is an object of the present invention to improve a short service life of a lamp encountered in the aforementioned problem. Particularly, an object of the invention is to provide a lighting device for a hot cathode fluorescent lamp, in an apparatus for operating a display for a very long period of time such as a personal computer or a word processor, which attempts to provide a longer life of a hot cathode fluorescent lamp for a back light having a liquid crystal display with a back light.

For achieving the aforesaid object, a lighting circuit having a pre-heating means for heating an electrode when a fluorescent lamp is started is employed in a lighting device for a hot cathode fluorescent lamp.

When the lamp is lighted after a filament has been preheated, sufficient hot electrons are supplied from an oxide heated by current. Therefore, time of a glow-discharge state during the lighting of the lamp is very short, and the glow-discharge state shifts to an arc-discharge soon. Therefore, as a result, an ion impact is rarely applied to the filament.

The aforesaid pre-heating means also pre-heats an electrode not only at the time of starting up the lamp but during the lighting.

Further, a lighting circuit is designed so that a pre-heat current value during the lighting is set to be smaller than that of starting in order to decrease a power loss due to the pre-heating of the electrode during the lighting.

Particularly, with respect to the power loss caused by a pre-heating current during lighting, it is preferred in a fluorescent lamp having electrodes on opposite ends thereof that a power dip caused by the pre-heating during lighting per one end does not exceed 1 Watt.

The lighting device for a hot cathode fluorescent lamp according to the present invention is preferably applied to a personal computer or a word processor having a liquid crystal display with a back light as previously mentioned. These displays have a larger image plane than that of a display for a liquid crystal television. The size of a fluorescent lamp with a back light used for the aforementioned display is larger than that of the liquid crystal television.

In a personal computer or a word processor having a liquid crystal display, a restriction of suppressing consumption wattage of the whole system is present similarly to a liquid crystal television but the restriction is somewhat less than that of the liquid crystal television.

Therefore, the lighting device for a hot cathode fluorescent lamp according to the present invention is provided with a pre-heating means for an electrode.

In the present invention, a pre-heating current is caused to flow not only at the time of starting up the lamp but also during lighting. Further, a value of the pre-heating current during lighting is made smaller than that at the time of starting.

The reason therefor is that a hot spot temperature is optimized even during the lighting.

That is, in a fluorescent lamp according to the present invention, since a current value of the lamp is small as compared with that of lamps for ordinary uses, a hot spot temperature of a filament is too low by the mere presence of a current of the lamp during the lighting. When the hot spot temperature is excessively low, hot electrons are forcibly discharged, and as a result, the oxide adhered to the filament is severely consumed to shorten the life of the lamp.

Therefore, in the present invention, a pre-heating current is also caused to flow in addition to the lamp current during the lighting of the lamp to elevate the hot spot temperature of the filament to a value as desired.

It is to be noted that the value of the pre-heating current during the lighting of the lamp is made to be lower than that at the time of starting up the lamp because when the value of the pre-heating current during the lighting of the lamp increases to a level equal to that at the time of starting up the lamp, the hot spot temperature of the filament excessively rises conversely so that barium of the electrode becomes vaporized within a short period of time to unfavorably shorten its life.

Furthermore, in the present invention, it is preferable that an electrode of a hot cathode fluorescent lamp is formed into a triple coil for a longer life of the lamp.

The lighting device for a hot cathode fluorescent lamp according to the present invention has no primary factor to substantially impede formation of an electrode into a triple coil. It is therefore preferable that an electrode is formed into a triple coil to prolong the life of the lamp.

Moreover, for those lamps for which compactness is required such as a fluorescent lamp 1 for a back light, a small diameter of a lamp is desirable. If the diameter of the lamp is small, the size of an electrode is small as compared with those of ordinary use. Therefore, the quantity of oxide to be contained in the electrode tends to be decreased.

In order to improve the tendency of shorter life of a lamp as described above, it is preferable to form an electrode into a triple coil in place of a conventional electrode in the form of a double coil to increase the quantity of oxide.

Furthermore, when a triple coil having a core in an electrode is used, falling of oxide adhered to the filament caused by vibration and impact can be relieved. Therefore, such a configuration as just mentioned is desirably employed. The triple coil is preferably formed of a first coil further wound to form a double coil, and the double coil combination being further wound to form the triple coil. The triple coil include a core if desired.

DESCRIPTION OF THE PREFERRED EMBODIMENT

In a preferred embodiment of the present invention, an inverter is used as a lighting circuit of a lamp. Two independent pre-heating circuits are provided on the secondary circuit of a transformer of the inverter, in addition to the lamp lighting circuit, so as to pre-heat and start the lamp.

Figure 1:
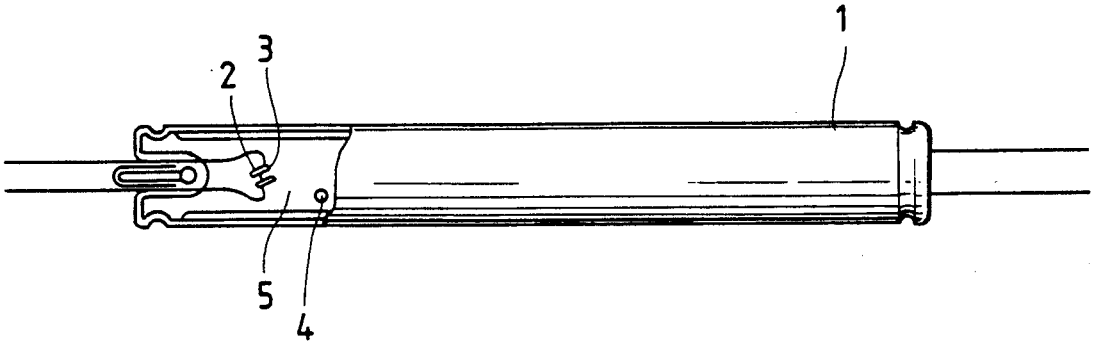
FIG. 1 is a view showing the configuration of a fluorescent lamp according to an embodiment of the present invention.
Figure 2:
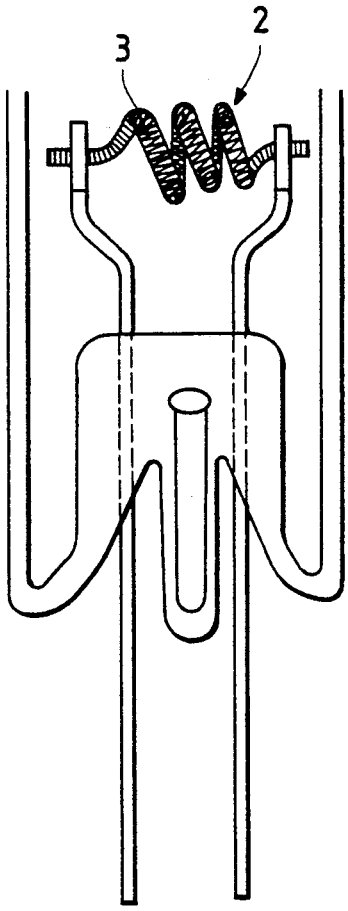
FIG. 2 is an enlarged view showing the neighborhood of an electrode shown in FIG. 1.

FIG. 1 shows the construction of a fluorescent lamp according to an embodiment of the present invention; and FIG. 2 is an enlarged view of the neighborhood of an electrode shown in FIG. 1.

In FIG. 1, cores 2 MG (throughout the description, 2 MG means that the weight of core per length of 20 cm of the core is 2 Mg) are provided on opposite ends of a glass tube 1. 2 mg of oxide 3 are contained in a triple coil 2 of the primary winding 1 MG. Preferably, a coil material of 1 to 3 MG is used for a coil for the core, and a coil material of 1 MG or less is used for a coil for a primary winding wound about the core. Mercury 4 and argon gas 5 are further filled into the tube. The pressure of Ar is preferably 12 Torr.

Figure 3:
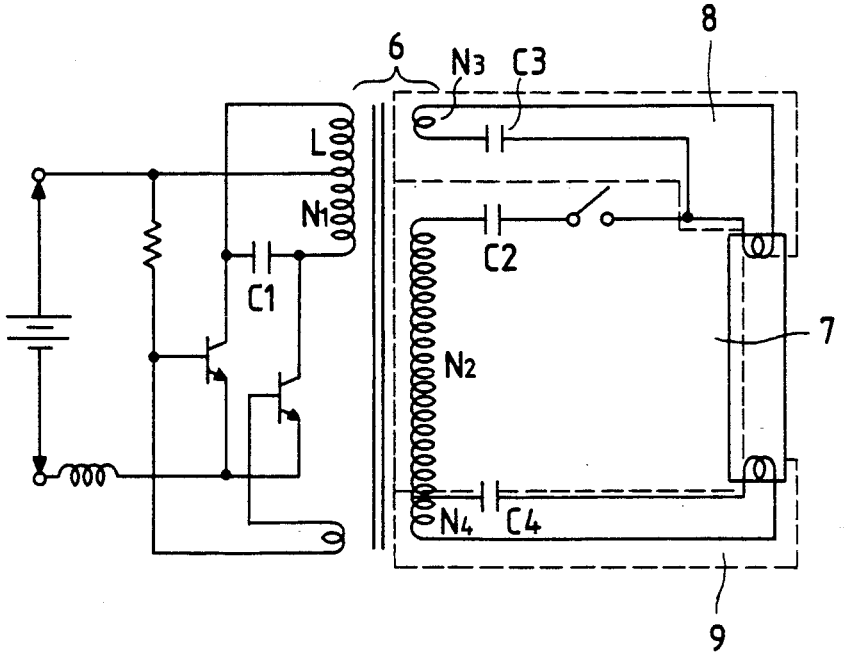
FIG. 3 is a view showing a lighting circuit according to an embodiment of the present invention.

The circuit configuration of a lighting circuit is shown in FIG. 3. The oscillation system shown in FIG. 3 is a general oscillation system of a 2-transistor push-pull circuit, in which the transistors are alternately turned ON and OFF to generate a sinusoidal-wave voltage in the primary of the transformer to light the lamp by a circuit 7 on the secondary of the transformer.

The circuit 7 is provided with a switch. This switch is initially in an OFF state at the time of starting up the lamp, and both electrodes of the lamp are pre-heated by pre-heating circuits 8 and 9. When the switch is turned ON, the lamp is lighted.

Figure 4:
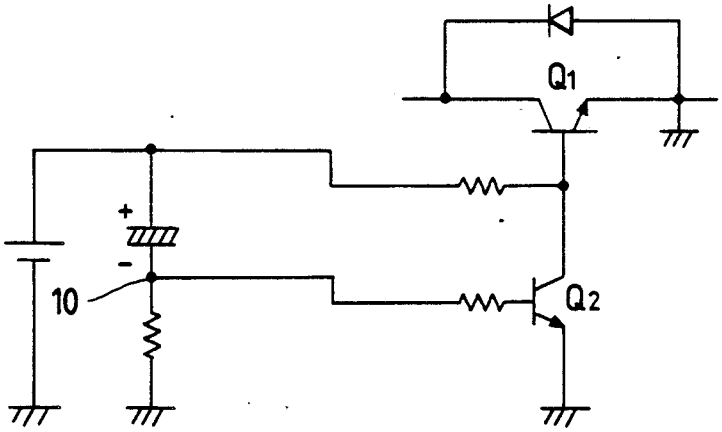
FIG. 4 is a view showing an embodiment of a switch circuit used as a switch shown in FIG. 3.

As this switch, a switch circuit, for example, as shown in FIG. 4, is used.

The circuit shown in FIG. 4 will be briefly described. An RC time constant circuit is used for a power source for opening and closing the switch.

While charging a capacitor, a node 10 is in a high state, and therefore, a transistor $Q_2$ assumes an ON state. Accordingly, since a base current to be supplied to transistor $Q_1$ flows as a collector current of $Q_2$, $Q_1$ is turned OFF, that is, the switch is turned OFF. Then, when the capacitor is sufficiently charged so that the node 10 assumes a low state, $Q_2$ is turned OFF while $Q_1$ is turned ON.

When the switch is turned OFF of at the time of pre-heating, oscillation frequency $f_1$ is substantially given by $$f_1 = \frac{1}{2\pi\sqrt{L\left(C_1 + \left(\frac{N_3}{N_1}\right)^2 C_3 + \left(\frac{N_4}{N_1}\right)^2 C_4\right)}} \quad (1)$$

wherein L represents the primary inductance of the transformer; $C_1$ the resonant capacitor's capacitance on the primary; $C_3$ and $C_4$ the pre-heating capacitor's capacitance on the secondary; $N_1$ the number of turns of the primary winding; and $N_3$ and $N_4$ the number of turns of the pre-heating circuit transformer windings.

When the switch is turned ON so that the lamp is lighted, oscillation frequency $f_2$ is substantially given by $$f_2 = \frac{1}{2\pi\sqrt{L\left(C_1 + \left(\frac{N_3}{N_1}\right)^2 C_3 + \left(\frac{N_4}{N_1}\right)^2 C_4 + \left(\frac{N_2}{N_1}\right)^2 C_2\right)}} \quad (2)$$

Figure 5A:
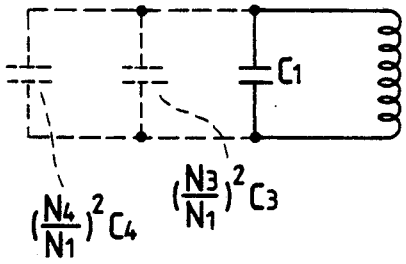
FIGS. 5*a* and 5*b* are respectively views showing a partial equivalent circuit of the lighting circuit shown in FIG. 3.
Figure 5B:
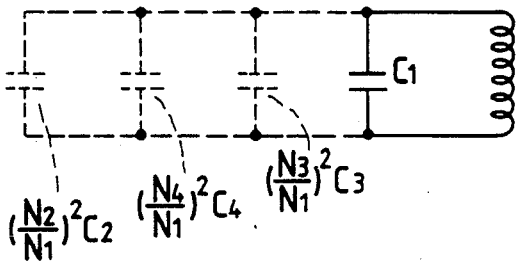

Formula (1) and formula (2) are derived from a partial equivalent circuit of FIG. 3 as shown in FIG. 5*a* and FIG. 5*b*.

It is understood from the foregoing that the frequency during lighting and the frequency at the time of pre-heating are in the relationship of $f_1 > f_2$. Accordingly, it is understood that a pre-heat current is high at the time of pre-heating while the pre-heat current is low during lighting.

Further, the longer the time from turn-on to turn-off of the switch, the better the temperature rising of the filament, which is preferable. However, when the time is excessively long, it takes time for starting up the lamp, which involves a problem. Practically, the time is from 1 to 3 seconds.

The lamp and the inverter are combined and a pre-heat current is set to 230 mA, a lamp current set to 60 mA and a switch time set to 2 seconds to confirm the life of the lamp. As a result, an assurance was made that there is no problem in the life of the lamp for 20,000 hours.

For the back light, 10,000 hours are necessary, and it was assured that this is a level capable of being practically used.

By employment of such a configuration as described above, a power loss caused by the pre-heat current after lighting of a fluorescent lamp having electrodes on opposite ends is less than 1 W per one end. In view of experiences, the power loss in this case is of the order of 10% of the whole power of the lamp.

According to the present invention, there is provided a hot cathode lamp lighting device which has a long life of lamp even in applications which involve a very long use time, such as by a liquid crystal display.

Moreover, the hot cathode lamp has a luminescent efficiency about twice that of the cold cathode lamp presently often used for the back light, and therefore, the hot cathode lamp is excellent for use with a battery. In addition, since the heating value can be minimized, there is a merit that the design of radiation of the set can be advantageously made.

What is claimed is:

1. A lighting device for a fluorescent lamp, comprising:

a pair of electrodes, each of which has a coil and an electron-emissive substance adhered to said coil;

a hot cathode fluorescent lamp having said pair of electrodes;

a secondary transformer winding having first and second coils electrically connected together at a node;

means connecting the node to one of said electrodes;

a first means for supplying a pre-heating current to each coil of said pair of electrodes;

a second means for supplying a lighting current between said pair of electrodes, including the second coil of said secondary transformer winding; and a switch for cutting off the lighting current supply from the second means when said fluorescent lamp is undergoing pre-heating by the first means, and for permitting the supply of said lighting current between said pair of electrodes from said second means after the pre-heating of each said coil of said pair of electrodes is conducted by the first means for a time necessary for lighting said fluorescent lamp, wherein said second means includes means connecting the second coil to the other of said electrodes via said switch, so that lighting current flows through said second coil when said switch is closed to thereby lower the total pre-heating current flowing through both coils as compared to the pre-heating current when said switch is open.

2. A lighting device for a fluorescent lamp according to claim 1, wherein each said electrode coil comprises a triple coil, and oxide is coated on said coil.

3. A lighting device for a fluorescent lamp according to claim 2, wherein each said electrode coil is formed of a tungsten material, and each said triple coil includes a core and a wire that is singly wound about the core, the wire and core being further wound in the form of a double coil to obtain the triple coil.

4. A lighting device for a fluorescent lamp according to claim 3, wherein a coil material of more than 1 MG but less than 3 MG is used for said core, and a coil material of less than 1 MG is used for said wire of said triple coil.

* * * * *